US011548173B2

(12) United States Patent
Chen

(10) Patent No.: US 11,548,173 B2
(45) Date of Patent: Jan. 10, 2023

(54) BLADE MOUNTING BRACKET AND BLADE REPLACEABLE KNIFE

(71) Applicant: Sheng Chen, Ningbo (CN)

(72) Inventor: Sheng Chen, Ningbo (CN)

( * ) Notice: Subject to any disclaimer, the term of this patent is extended or adjusted under 35 U.S.C. 154(b) by 0 days.

(21) Appl. No.: 17/341,413

(22) Filed: Jun. 8, 2021

(65) Prior Publication Data

US 2022/0088805 A1 Mar. 24, 2022

(30) Foreign Application Priority Data

Sep. 24, 2020 (CN) ..... 202022124955.1

(51) Int. Cl.
*B26B 1/04* (2006.01)

(52) U.S. Cl.
CPC ..... *B26B 1/04* (2013.01)

(58) Field of Classification Search
CPC .. B26B 1/04; B26B 5/00; B26B 5/005; B26B 5/006; A61B 17/3213
See application file for complete search history.

(56) References Cited

U.S. PATENT DOCUMENTS 4,930,220 A * 6/1990 Loo ..... A61B 17/3213 30/339
5,167,069 A * 12/1992 Quinn ..... B26B 21/523 30/527
11,090,820 B1 * 8/2021 Wu ..... A61B 17/3213
2003/0177648 A1 * 9/2003 Zeiter ..... B26B 21/523 30/526
2004/0107585 A1 * 6/2004 Helmrich ..... B26B 21/523 30/537
2007/0062043 A1 * 3/2007 Marut ..... B26B 21/523 30/50
2015/0148596 A1 * 5/2015 Gitman ..... A61B 18/1402 600/104
2019/0217489 A1 * 7/2019 Cheng ..... B26B 1/044
2021/0276205 A1 * 9/2021 Wu ..... A61B 17/3213

FOREIGN PATENT DOCUMENTS

DE 103 39 166 A1 * 3/2005 ..... A61B 17/3213

* cited by examiner

*Primary Examiner* — Omar Flores Sanchez

(57) ABSTRACT

A blade mounting bracket includes a blade mounting part and a handle connecting part. A blade mounted on the blade mounting bracket defines a strip-shaped hole. The strip-shaped hole includes a mounting section and a tightening section. A width of the mounting section is greater than a width of the tightening section. The blade mounting part includes a base and a fixing piece connected with the base. An upper surface of the fixing piece is matched with the mounting section. An upper portion of the fixing piece extends downwards to connect with the base. Grooves are formed between the upper surface of the fixing piece and the base. The fixing piece includes a fixing block matched with the mounting section. The grooves and the fixing block fix the blade in a plane in which the blade is located.

6 Claims, 3 Drawing Sheets

BLADE MOUNTING BRACKET AND BLADE REPLACEABLE KNIFE

FIELD OF THE DISCLOSURE

The disclosure relates to the field of cutting tools, in particular to a blade mounting bracket and a blade replaceable knife.

BACKGROUND OF THE DISCLOSURE

A multifunctional folding knife or a tactical knife with a replaceable blade can also improve the use efficiency and the service life of the knife in outdoor or wild-field survival or some tactical scenes, so that the knife with the replaceable blade has a wide application prospect. In similar application scenarios, such as surgical knives used in surgery, there is also a need to replace or change blades, and currently the blade replaceable knives are primarily applied in these scenarios.

The blade replaceable knife should meet at least the following requirements: firstly, it is convenient to replace the blade, the steps are convenient and simple, the safety of a user can be ensured as far as possible during replacement, and accidental cuts are avoided; secondly, the knife before and after blade replacement can be normally used, the stability of the integral structure of the original knife is not damaged, and once again, the knife can have wide adaptability, namely, the knife can adapt to various types of blades within a certain size range of the blade/knife.

Chinese invention patent with publication number "CN103786170B" discloses a blade replaceable knife, comprising: a blade comprising a cutting edge part and a fixing part, a root portion of the cutting edge part being provided with a hole; a left gasket and a right gasket for clamping the blade, the left gasket or the right gasket being provided with a clamping nail for being matched with the hole on the cutting edge part; and a button capable of contacting a hole for driving the left gasket or the right gasket and separating the clamping nail from the root portion of the cutting edge part. The blade is locked by the clamping nail on the gasket under the action of the elastic force of the metal. By means of deformation of the elastic sheet, a button on the knife body is pressed to unlock, so that a user can change the knife conveniently. However, the traditional cutting edge is divided into four pieces, two pieces are used for clamping, one piece is used for fixing, and the other piece is the cutting edge for cutting. Although replacement is facilitated, the structure is complicated, and the manufacturing cost is high. Although the process of dismounting the cutting edge is simple, the process of reassembling a new cutting edge is also relatively complicated.

SUMMARY OF THE DISCLOSURE

The technical problem to be solved by the disclosure is to provide a blade bracket which is simple in structure, convenient and quick to disassemble an old blade and mount a new blade, and to provide a knife adopting the blade bracket.

The technical solution adopted by the disclosure for solving the above-mentioned technical problems is as follows.

A blade mounting bracket comprises a blade mounting part and a handle connecting part which are connected with each other, a mounted blade being provided with a strip-shaped hole, the strip-shaped hole being provided with a mounting section and a tightening section which are sequentially connected and communicated with each other, a width of the mounting section being greater than a width of the tightening section, wherein the blade mounting part comprises a base and a fixing piece which are connected with each other, an upper surface of the fixing piece is matched with the mounting section, the upper surface of the fixing piece extends downwards and is connected with the base; a groove/grooves is/are formed between the upper surface of the fixing piece and the base, the fixing piece is further provided with a fixing block matched with the mounting section, the groove and the fixing block fix the blade in a plane in which the blade is located, and the upper surface of the fixing piece and the base fix the blade in a direction perpendicular to the plane in which the blade is located.

Further, the grooves are symmetrically arranged in an axial direction in a pair.

Further, spacing between bottom surfaces of the pair of grooves is matched with the width of the tightening section.

Further, a width of the upper surface of the fixing piece is greater than the spacing between the bottom surfaces of the pair of grooves.

Further, a thickness of the fixing piece is greater than a thickness of the blade.

Further, an axial length of the fixing block is less than or equal to a length of the mounting section, and a sum of the axial length of the fixing block and a length of the groove is greater than the length of the mounting section.

Further, the blade mounting bracket further has an unlocking member.

Further, the unlocking member comprises a reed and a button, a first end of the reed is fixed on a back of the blade mounting bracket, and a second end of the reed is fixedly connected with the button.

Further, the blade mounting bracket further comprises a hole that allows the button to pass through, the button being located in the hole in a natural state.

The disclosure further provides a blade replaceable knife, comprising a handle shell and a blade mounting bracket rotatably connected with the handle shell, and the blade mounting bracket is any of the above-mentioned blade mounting brackets.

Compared with the prior art, the present disclosure has the following advantages. A simple fixing piece is adopted to mount the blade by utilizing a structure of a universal blade and combining metal characteristics of the blade. A simple unlocking mechanism is utilized to realize easy dismounting of the blade, a user does not need to directly contact the cutting edge in the mounting and dismounting processes, and safety of the user is guaranteed.

DETAILED DESCRIPTION OF THE DISCLOSURE

The present disclosure is described in further detail below with reference to the embodiments of the drawings.

Figure 1:
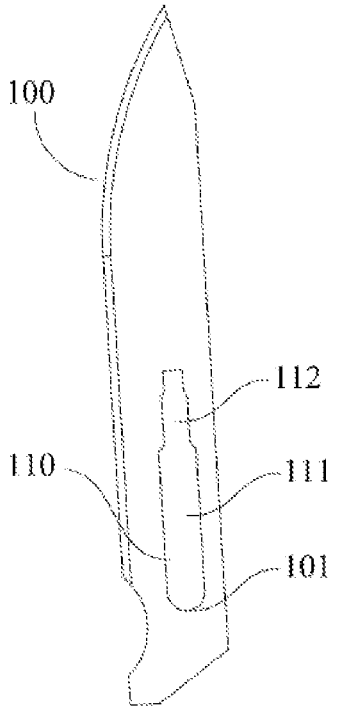
FIG. 1 is a schematic view showing a structure of a replaceable blade mounted on a blade mounting bracket of the present disclosure.

Reference is made to FIGS. 1-9. A blade mounting bracket 200 of the present disclosure is used for mounting a universal blade 100 as shown in FIG. 1, the universal blade 100 is provided with a universal strip-shaped hole 110, the strip-shaped hole 110 comprises a mounting section 111 and a tightening section 112 which are sequentially connected and communicated with each other, and a width of the mounting section 111 is greater than a width of the tightening section 112. Namely, The mounting section 111 is wider than the tightening section 112 in a direction perpendicular to a length direction of the strip-shaped hole 110 on a plane in which the blade 100 is located.

Figure 2:
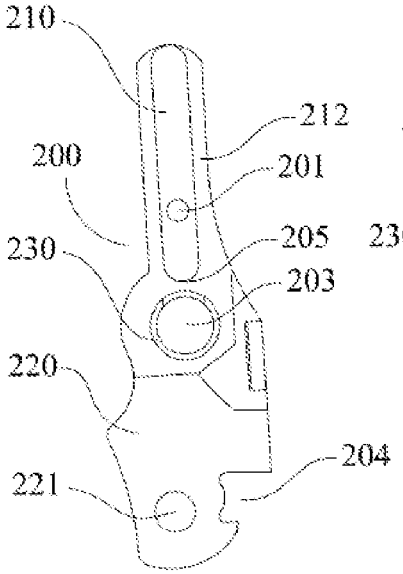
FIG. 2 is a schematic view showing a front structure of the blade mounting bracket of the present disclosure.
Figure 3:
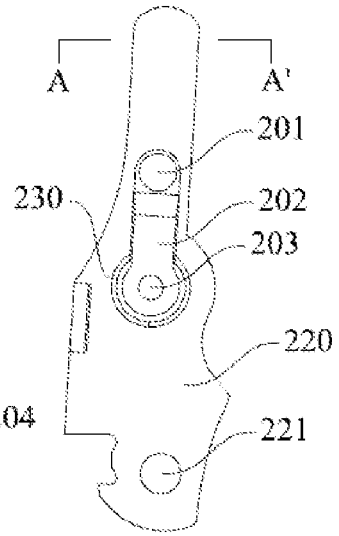
FIG. 3 is a schematic view showing a rear structure of the blade mounting bracket of the present disclosure.
Figure 4:
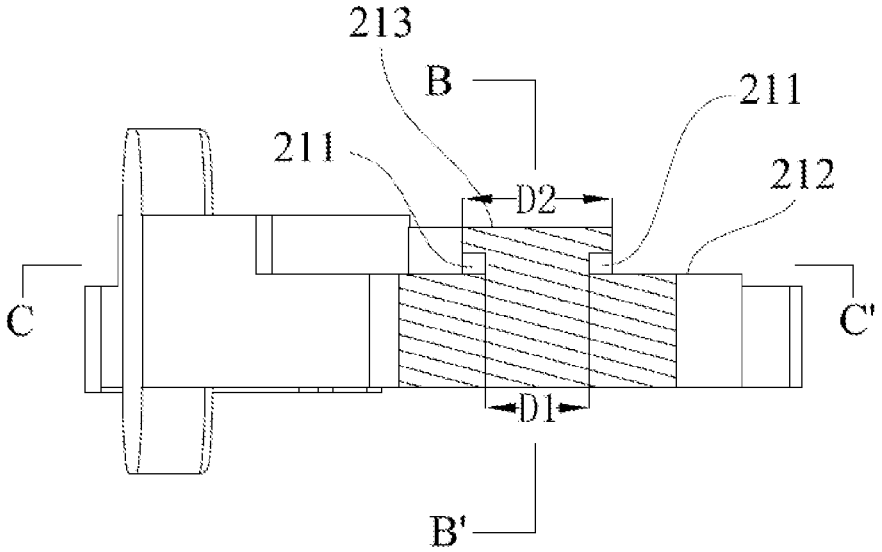
FIG. 4 is a sectional view taken along the direction A-A' of FIG. 3.
Figure 5:
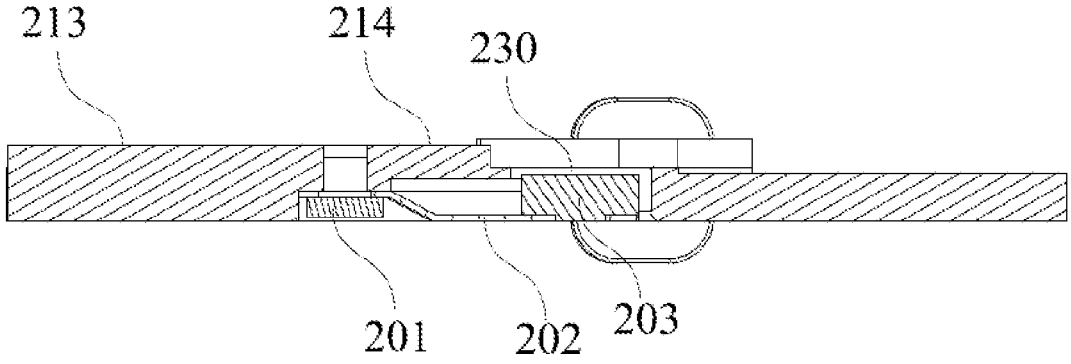
FIG. 5 is a sectional view taken along the direction B-B' of FIG. 4.
Figure 6:
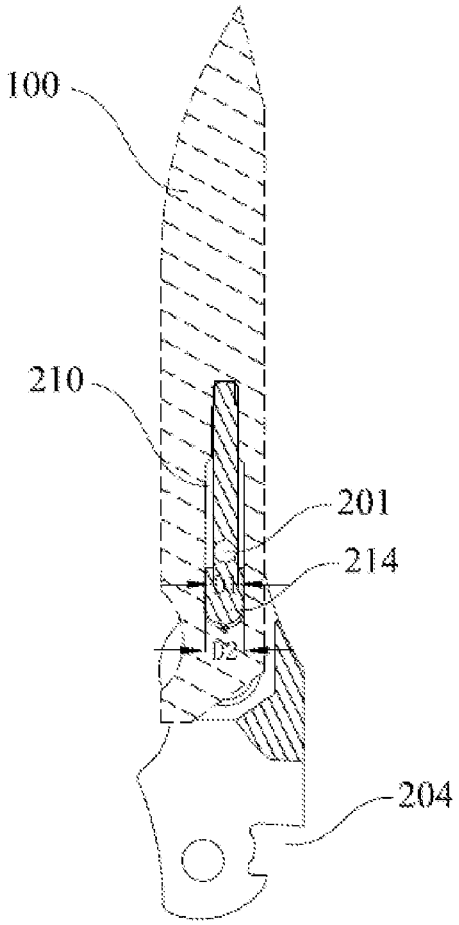
FIG. 6 is a sectional view taken along the direction C-C' of FIG. 4.
Figure 7:
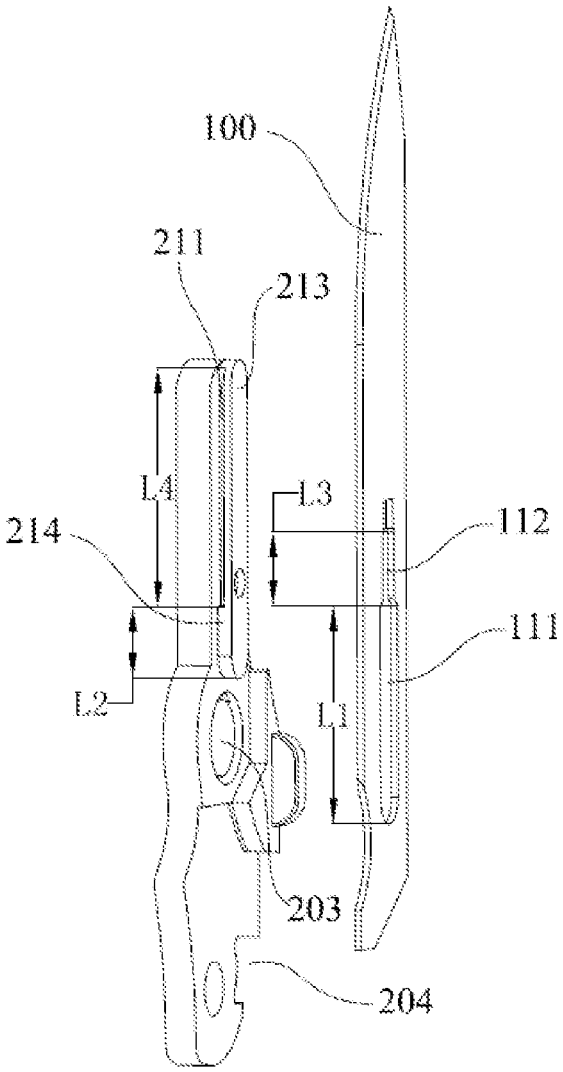
FIG. 7 is a schematic view showing an exploded structure of the blade mounting bracket and the blade of the present disclosure.

As shown in FIGS. 2-5, the blade mounting bracket 200 comprises a blade mounting part 210 and a handle connecting part 220 connected with the blade mounting part 210. The blade mounting part 210 is shown in FIG. 4. The blade mounting part 210 comprises a base 212 and a fixing piece 213 which are connected with each other, and an upper surface of the fixing piece 213 is matched with the mounting section 111 of the strip-shaped hole 110 (being matched means: same shape and/or same width, or being capable of interference fit, the same below). An upper surface of the fixing piece 213 extends downward and is connected with the base 212. A pair of axially (i.e. in a direction extending along a length direction of the fixing piece 213, the same below) symmetric grooves 211 are formed between the upper surface of the fixing piece 213 and the base 212 at a first end of the fixing piece 213 along the length direction of the fixing piece 213; at a second end of the fixing piece 213, a fixing block 214 having a width and a shape both matched with the mounting section 111 is formed, and a thickness of the fixing block 214 (i.e., the thickness in a direction perpendicular to the upper surface of the fixing piece 213) is greater than a thickness of the blade 100, while the fixing block 214 serves as a closed end of the groove 211 for limiting a moving range of the blade 100 along the groove 211. In order to better fix the blade 100, in addition to fixing the mounting section 111 with the fixing block 214, the tightening section 112 is further fixed with bottom surfaces of the pair of grooves 211. Namely, spacing D1 between the bottom surfaces of the pair of grooves 211 is set to be matched with the width of the tightening section 112. For example, D1 is the same as the width of the tightening section 112. Alternatively, the bottom surfaces of the pair of grooves 211 form an interference fit with both side edges of the tightening section 112. In one embodiment, a length of the mounting section 111 of the strip-shaped hole 110 is L1, a length of the tightening section 112 is L3, an axial length of the fixing block 214 is L2, and a length of the groove 211 is L4, where L2<L1, and L2+L4>L1, such that it is guaranteed that at least a part of the tightening section 112 is clamped with the bottom surface (or a part of the bottom surface) of the groove 211 after mounting, and a part of the mounting section 111 is clamped with a side wall of the fixing block 214, such that the whole blade 100 has at least two groups of fixing points, and the two groups of fixing points realize the stabilization in various directions in the plane in which the blade 100 is located at the same time. Also, a width D2 of the upper surface of the fixing piece 213>the spacing D1 between the bottom surfaces of the pair of grooves 211, such that the tightening section 112 is blocked by the upper surface of the fixing piece 213 without being separated from the fixing piece 213 in the direction perpendicular to the blade 100, and the base 212, as a mounted base, certainly blocks a displacement of the blade 100 in the direction perpendicular to the blade 100. Thus, the blade 100 can be stably held on the blade mounting bracket 200 by the upper surface of the fixing piece 213 and the base 212. When the blade 100 is mounted, one end, close to the mounting section 111, of the blade 100 is tilted upward, and one end close to the tightening section 112 is caught along one end of the groove 211. The blade 100 is pushed toward the fixing block 214 in the axial direction, during which a slight elastic deformation (slight bending, the same below) occurs in the blade 100 due to its metal characteristics. When a first edge 101 of the mounting section 111 in its axial direction moves above a second edge 205 of the fixing block 214, one end, close to the first edge 101, of the blade 100 is pressed downwards along with the force. The mounting section 111 is clamped outside the fixing block 214, and the first edge 101 is tightly attached to the second edge 205. At the moment, the tightening section 112 is also tightly clamped to the bottom surface of the groove 211, and the blade 100 returns to its original shape and the mounting is completed.

The blade mounting bracket 200 also has an unlocking member thereon for assisting a user in conveniently dismounting the blade 100. In one embodiment, the unlocking member comprises a reed 202 and a button 203, a first end of the reed 202 is fixed on a back of the blade mounting bracket 200 (i.e., the side where the blade is not mounted, the same below), and a second end of the reed 202 is fixedly connected with the button 203 as shown in FIG. 3. In one embodiment, the first end of the reed 202 is fixedly connected with the blade mounting bracket 200 by a rivet 201. The blade mounting bracket 200 is provided with a hole 230 that allows the button 203 to pass through and push the blade 100 close to one end of the fixing block 214, and in a natural state, the button 203 is completely located in the hole 230 without affecting the normal use of the blade. Since the button 203 is completely located in the hole 230, the probability that the button 203 is mistakenly touched is greatly reduced, and accidental unlocking is prevented. When it is desired to replace the blade, the user can press the button 203 on the back of the blade mounting bracket 200, the button 203 contacting the end, close to the first edge 101, of the blade 100 (i.e., the end close to the fixing block 214) and applying a force to this end to move it in a direction away from the fixing block 214 until the end, close to the first edge 101, of the blade 100 is gradually lifted, and a slight elastic deformation occurs in the blade 100 again. When the end, close to the first edge 101, of the blade 100 is separated from the fixing block 214, the blade 100 can be pushed or pulled outwards in the axial direction. When the tightening section 112 leaves the groove 211, the blade can be easily removed and a new blade can be prepared for mounting. In other embodiments, the unlocking member may have other structures as long as it can assist a user in lifting one end of the blade 100 away from the fixing block 214, such as a lever mechanism or a push-pull mechanism mounted on the blade mounting bracket 200, which will not be described in detail herein.

Figure 8:
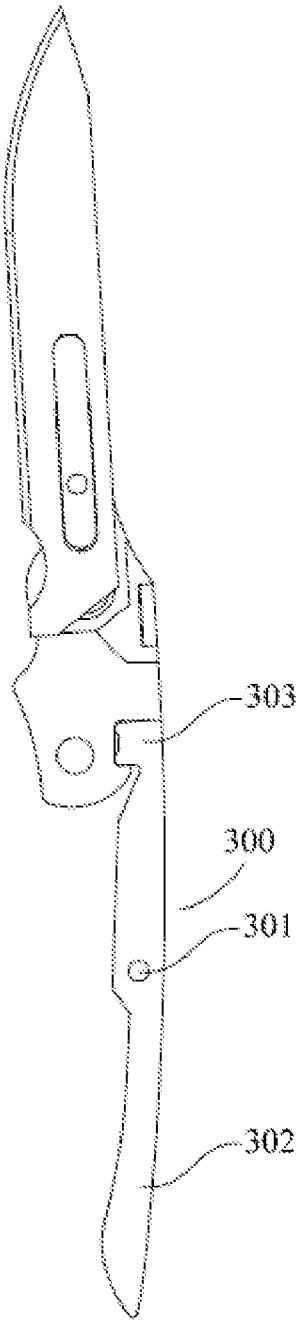
FIG. 8 is a schematic view showing a combined state structure of the blade mounting bracket, the blade and the locking member of the present disclosure.
Figure 9:
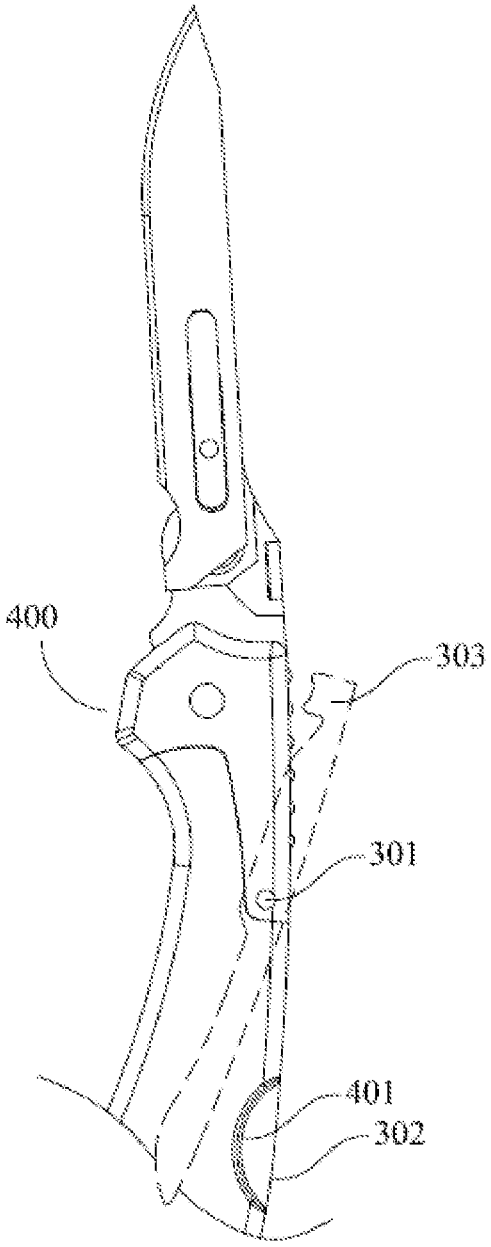
FIG. 9 is a schematic view showing a structure of a knife to which the blade mounting bracket of the present disclosure is applied.

As shown in FIGS. 2, 8 and 9, the handle connecting part 220 is rotatably connected with the handle shell 400 through a first rotation shaft 221. The handle connecting part 220 also has a bayonet 204 thereon, and a folding lever 300 has a bayonet fitting 303 for mating engagement with the bayonet 204. The handle shell 400 is rotatably connected with the folding lever 300 through a second rotation shaft 301, the handle shell 400 has a recess 401, and the folding lever 300 has a pressing part 302 positioned in the recess 401. When the pressing part 302 is pressed, the folding lever 300 rotates around the second rotation shaft 301, the bayonet fitting 303 leaves the bayonet 204, and the blade mounting bracket 200 can be folded and received into the handle shell 400 around the first rotation shaft 221.

What is claimed is:

1. A blade replaceable knife, comprising a handle shell and a blade mounting bracket rotatably connected with the handle shell, wherein the blade mounting bracket comprises a blade mounting part and a handle connecting part which are connected with each other, wherein a blade is mounted on the blade mounting bracket; the blade has a strip-shaped hole; the strip-shaped hole being provided with a mounting section and a tightening section which are sequentially connected and communicated with each other, a width of the mounting section being greater than a width of the tightening section, wherein the blade mounting part comprises a base and a fixing piece which are connected with each other, an upper surface of the fixing piece is matched with the mounting section, a lower portion of the fixing piece extends downwards from the upper surface and connects with the base; grooves are formed between the upper surface of the fixing piece and the base, the fixing piece is further provided with a fixing block matched with the mounting section, grooves and the fixing block fix the blade in a plane in which the blade is located, and the upper surface of the fixing piece and the base fix the blade in a direction perpendicular to the plane in which the blade is located;

wherein the blade mounting bracket further has an unlocking member;

wherein the unlocking member comprises a reed, a button and a hole allowing the button to pass through, a first end of the reed is fixed on a back of the blade mounting bracket, and a second end of the reed is fixedly connected with the button; the button pushes one end of the blade to move upwards towards one end of the fixing block, so the blade is separated from the blade mounting bracket; the button is completely located in the hole when the blade is mounted on the blade mounting bracket;

wherein the handle connecting part is rotatably connected with the handle shell through a first rotation shaft; the handle connecting part comprises a bayonet configured to be movably engaged with a bayonet fitting of a folding lever; the handle shell is rotatably connected with the folding lever through a second rotation shaft, the handle shell has a recess, and the folding lever has a pressing part positioned in the recess; when the pressing part is pressed, the folding lever rotates around the second rotation shaft such that the bayonet fitting is removed from engagement and the bayonet fitting is not engaged with the bayonet, so the blade mounting bracket is foldable about the first rotation shaft and is receivable into the handle shell.

2. The blade replaceable knife according to claim 1, wherein the grooves are symmetrically arranged in an axial direction in a pair.

3. The blade replaceable knife according to claim 2, wherein spacing between bottom surfaces of the pair of grooves is matched with the width of the tightening section.

4. The blade replaceable knife according to claim 3, wherein a width of the upper surface of the fixing piece is greater than the spacing between the bottom surfaces of the pair of grooves.

5. The blade replaceable knife according to claim 1, wherein a thickness of the fixing piece is greater than a thickness of the blade.

6. The blade replaceable knife according to claim 1, wherein an axial length of the fixing block is less than or equal to a length of the mounting section, and a sum of the axial length of the fixing block and a length of each of the grooves is greater than the length of the mounting section.

* * * * *